United States Patent [19]

Mochizuki

[11] Patent Number: 5,007,252

[45] Date of Patent: Apr. 16, 1991

[54] COMBINATION NECKLACE

[75] Inventor: Shigetoshi Mochizuki, Chofu-City, Japan

[73] Assignee: Satoru Yagi, San Francisco, Calif.

[21] Appl. No.: 433,651

[22] Filed: Nov. 8, 1989

[30] Foreign Application Priority Data

Jun. 20, 1989 [JP] Japan ..... 1-61737

[51] Int. Cl.[5] ..... A44C 5/00

[52] U.S. Cl. ..... 63/3; 63/2; 63/1.1

[58] Field of Search ..... 63/3, 5.1, 6, 9, DIG. 3, 63/1.1, 2

[56] References Cited

U.S. PATENT DOCUMENTS

| | | | |
|---|---|---|---|
| 2,051,591 | 8/1936 | Brogan | 63/2 X |
| 2,298,591 | 10/1942 | Ross | 63/2 X |
| 2,529,058 | 11/1950 | Tell et al. | 63/2 X |
| 2,867,052 | 1/1959 | Feibelman | 63/2 X |
| 3,323,324 | 6/1967 | Bohlinger et al. | 63/1.1 |
| 4,527,316 | 7/1985 | Murphy | 63/2 X |

FOREIGN PATENT DOCUMENTS

| | | | |
|---|---|---|---|
| 293216 | 6/1915 | Fed. Rep. of Germany | 63/3 |
| 2407849 | 9/1975 | Fed. Rep. of Germany | 63/2 |
| 919367 | 2/1963 | United Kingdom | 63/2 |
| 2069817 | 9/1981 | United Kingdom | 63/2 |

*Primary Examiner*—Laurie K. Cranmer

*Attorney, Agent, or Firm*—Flehr, Hohbach, Test, Albritton & Herbert

[57] ABSTRACT

A combination necklace that can be assembled in different configurations from separate necklaces of different or equal lengths. Each of these separate necklaces are comprised of a string of precious or semiprecious stones, with the end stones of each string having connection fittings. Joining stones are provided with built-in connection fittings. Either one or two of the joining stones are used to interconnect with the end stones of different combinations of the necklace strings. A gripping piece is provided to bundle together and grip selected portions of the necklaces to achieve different necklace configurations.

5 Claims, 4 Drawing Sheets

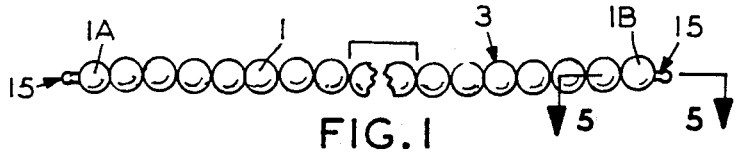
FIG. 1
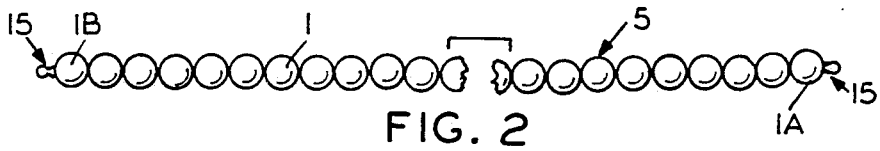
FIG. 2
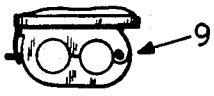
FIG. 4
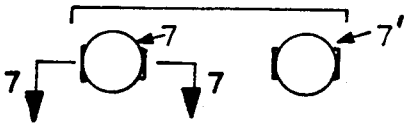
FIG. 3
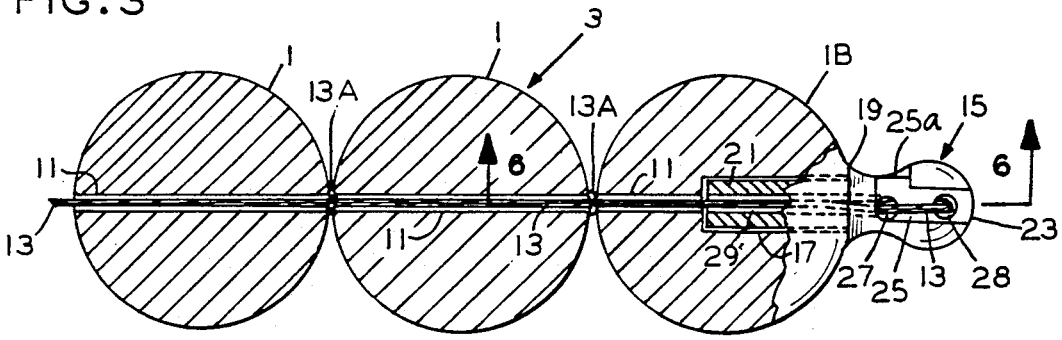
FIG. 5
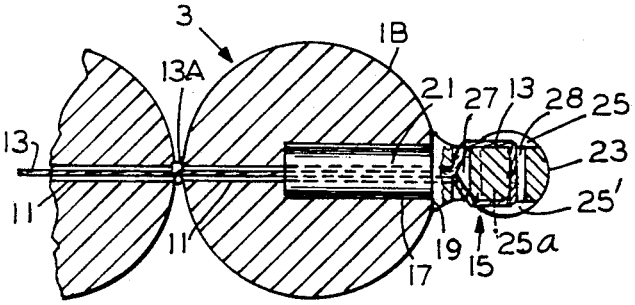
FIG. 6
FIG. 7
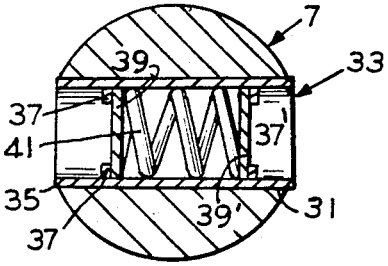
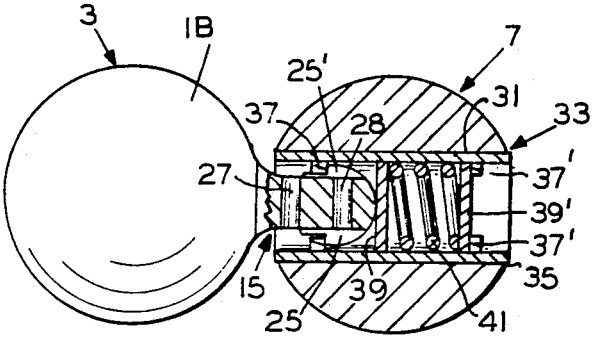
FIG. 9
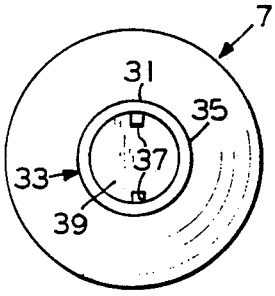
FIG. 8

COMBINATION NECKLACE

BACKGROUND OF THE INVENTION

The present invention relates in general to combination necklaces comprised of precious or semiprecious stones including pearls. More particularly, the invention relates to a necklace construction which permits necklaces of different types to be combined in different modes as appropriate for the particular dress, time, place and ambience.

For necklaces comprised of pearls, for example, the length of the necklace is generally standardized according to the style or purpose of use of the necklace. For instance, necklaces comprised of a plurality of pearls with diameters of approximately 7 mm and a length of 36 to 38 cm are called "chokers," a length of 40 to 43 cm are called "princesses," and a length of 76 to 81 cm are called "operas."

A choker is typically worn closely around the neck, while a princess is worn fairly loosely around the neck. An opera, which is meant to be worn for evening party use, is typically worn hanging down to the chest area as a single strand or around the neck as a double strand.

The time of use, purpose of use, and the like are prescribed for necklaces known as chokers, princesses, and operas. Within the prescribed use, a particular necklace is selected based on taste or the dress with which it is worn.

Heretofore, the selection and wearing of a necklace that fits one's taste and particular purpose of use requires the purchase of a number of separate necklaces which have been specifically manufactured as chokers, princesses or operas. This is expensive in that a selection of chokers, princesses and operas must be purchased to fit a range of taste, attire, and purpose of use.

OBJECTS AND SUMMARY OF THE INVENTION

It is a general object of the present invention to provide a new and improved combination necklace which can be readily adapted for different modes of use.

Another object of the invention is to provide a combination necklace of the type described that allows different types of necklaces to be easily configured to fit the specific time, place, and ambience as well as the dress with which they are used.

The invention in summary provides a combination necklace comprising at least one first necklace, one second necklace and two joining stones. As used herein the term "stones" includes pearls and other precious and semiprecious stones of the type typically used in necklaces. The first necklace is comprised of a string of precious stones which are connected together by means of stones at each end. The end stones are each provided with a first connection fitting. The second necklace is comprised of a string of precious stones of a similar type with the stones at each end provided with another first connection fitting similar to that of the first necklace. Each joining stone has a built-in second connection fitting that removably engages a first connection fitting from opposite directions.

Another embodiment of the invention provides a gripping piece that bundles and grips, in different configurations, either the first necklace with another first necklace, or the second necklace with another second necklace, or the first necklace with the second necklace.

The invention makes it possible to configure the first and second necklaces either at different lengths, or optionally so that the diameters of the first and second necklaces are approximately the same.

With the invention the first and the second necklaces can be joined using two joining stones to provide one large necklace. It is also possible for individual first necklaces or individual second necklaces to be joined using one joining precious stone to provide individual small necklaces.

Furthermore, the first connection fittings in the end stones of the necklaces engage the second connection fitting inside the joining stone and are thereby hidden from view.

Moreover, when configured with a gripping piece, it is possible to bundle and secure a necklace that is worn around the neck. It is also possible to bundle and secure necklaces that are worn around the neck with both ends hanging down over the chest. If joining stones are connected to both ends, the first connection fittings at both ends are hidden from view.

Also, when assembled using first and second necklaces of different lengths, it is possible to configure necklaces of different standards. If the first and the second necklaces and the joining stones are comprised of precious stones of approximately the same diameter, the first and second connection fittings become hidden and the joining stones become inconspicuous.

BRIEF DESCRIPTION OF THE DRAWINGS

FIG. 1 is a top plan view of a combination necklace according to one embodiment of the invention.

FIG. 2 is a top plan view of a necklace according to another embodiment.

FIG. 3 is a top plan view illustrating two of the joining stones used in the invention.

FIG. 4 is a side view of a pearl shortener used in the embodiments of the invention.

FIG. 5 is a fragmentary axial section view taken along the line 5—5 of FIG. 1.

FIG. 6 is a fragmentary axial section view taken along the line 6—6 of FIG. 5.

FIG. 7 is an axial section view of one of the joining stones along the line 7—7 of FIG. 3.

FIG. 8 is an end view of the joining stone of FIG. 7.

FIG. 9 is a partially sectioned plan view illustrating interconnection of the end stone of FIG. 3 with the joining stone of FIG. 4.

DESCRIPTION OF THE PREFERRED EMBODIMENTS

Figure 12:
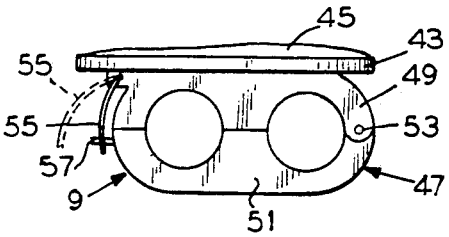
FIG. 12 is an enlarged side view of the pearl shortener of FIG. 4.
Figure 13:
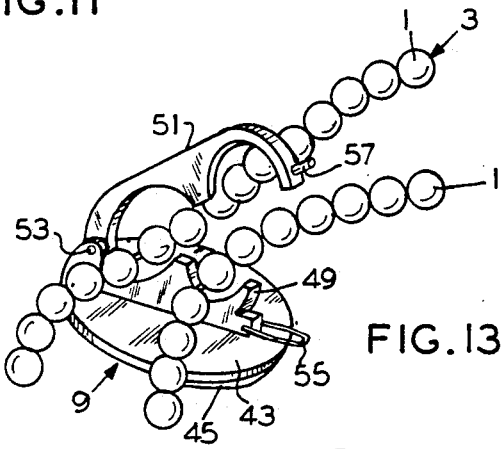
FIG. 13 is a perspective view illustrating the pearl shortener of FIG. 12 shown at one step of the operation for connecting with portions of the necklace of FIG. 1.

In the drawings FIG. 1 illustrates a component of the combination necklace which comprises the first necklace 3 having a length in the range of 36 to 38 cm, which is commonly called a choker. The choker is comprised of a string of stones or pearls 1 each of which has a diameter of approximately 7 mm. The combination necklace includes a second necklace 5 of FIG. 2 having a length of 40 to 43 cm, which is commonly called a princess. The princess is comprised of a string of pearls 1 of a size and type similar to those used in choker 3. The combination necklace further includes at least one of the joining stones or pearls 7 and 7' shown in FIGS. 3, 7 and 8 which are made of pearls of a size and type similar to the pearls in the choker and princess. The gripping piece or pearl shortener 9 of FIGS. 4, 12 and 13 is provided for gathering and gripping the pearls in the choker and princess.

As shown in FIGS. 5 and 6, choker 3 is assembled with the required number of pearls 1 by passing a thin string 13 made of Nylon (a trademark of the duPont Corporation for a synthetic polyamide), silk, or a blend of the same through a hole 11 which penetrates through the center of each pearl. At opposite ends of the choker and princess end pearls 1A and 1B are provided, and each end pearl is formed with a protruding first connection fitting 15.

For each end pearl 1A and 1B, the inner diameter of penetration hole 11 is enlarged part way or countersunk to form an insertion hole 17 of a larger inner diameter. The first connection fitting 15 is inserted into hole 17 and secured with an adhesive (not shown in the figures).

The first connection fitting 15 is comprised of a narrow mating part 21 which protrudes from base 19 and which is fitted within insertion hole 17. A spherical insertion piece 23 protrudes outward from base 19 in an opposite direction from mating part 21. The neck of the insertion piece has a slightly smaller diameter to form a constricted section, as best shown in FIGS. 5 and 6.

Two guide grooves 25 and 25' are formed parallel on opposite sides of insertion piece 23 and run from near base 19 outwardly to the spherical tip of piece 23. Penetration hole 27 which connects the two guide grooves is formed through base 19. Each guide groove 25 makes an approximate 90° bend adjacent base 19, with the inner leg of the groove extending in a circumferential direction. Each groove then bends another 90° extending toward the tip to form return groove 25A. Penetrating hole 28 which joins opposed guide grooves 25 and 25' is formed near the tip of insertion piece 23. In the first connection fitting 15 a penetration hole 29 runs axially through mating part 21 from penetration hole 27 to the tip of mating piece 21.

String 13, which runs through the penetration holes 11 of the pearls, passes through penetration hole 29 and penetration hole 27 in first connection fitting 15. The string then runs along guide groove 25, penetration hole 28 and guide groove 25' and loops back through penetration hole 27 and penetration hole 29. Between each pair of pearls a knot 13A is formed to stop movement of the pearls relative to the string.

The configuration of princess 5 is the same as that of choker 3 other than the difference in the length and the number of pearls 1 which are strung together.

As FIGS. 7 and 8 show, joining pearl 7 is formed by securing a second connection fitting 33 to a large diameter penetration hole 31 formed in a pearl. The second connection fitting 33, which is secured to penetration hole 31 with an adhesive (not shown in the figures), is formed of a metallic retainer tube 35 that is fitted so as not to excessively protrude from the pearl. Located near both open ends on the inner surface of retention tube 35 are a pair of engagement protrusions 37 and 37' and a pair of retention plates 39 and 39'. The diameter of the retention plates are slightly smaller than the inner diameter of the retention tube. The retention plates are captured within the tube by means of the two engagement protrusions. The engagement protrusions are formed by bending a section of retention tube 35 upwards. A compression coil spring 41 is interposed between retention plates 39 and 39' so that these plates are pressed against the engagement protrusions. In other words, the retention plates and compression coil spring comprise a force application mechanism for the first connection fitting.

Assembly of the strings is illustrated in FIG. 9. A first connection fitting 15 on either pearl 1A or 1B of choker 3 is pressed into one end of second connection fitting 33 on joining pearl 7. Engagement protrusions 37 are then aligned with guide groove 25 of first connection fitting 15. Retention plate 39 is then pushed inward to the point that first connection fitting 15 is inserted into second connection fitting 33.

When either end pearl 1A or 1B is rotated by approximately 90° with respect to joining pearl 7 and then released, engagement protrusions 37 become engaged with the tip of return grooves 25*a* so as to secure choker 3 to joining pearl 7. Disassembly of the strings is the reverse of the foregoing steps.

Figure 10:
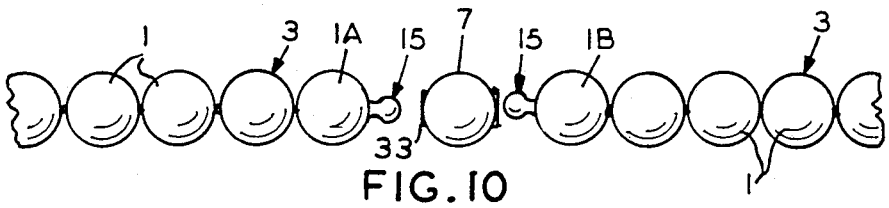
FIG. 10 is a top plan view illustrating the manner of positioning the joining stone of FIG. 7 for coupling with two of the end stones of FIG. 3.
Figure 11:
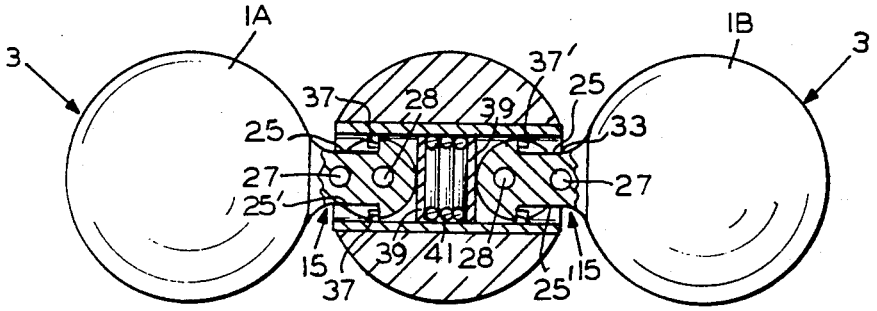
FIG. 11 is a partially sectioned plan view of the joining and end stones of FIG. 10 when they are coupled together.

If, as FIG. 10 shows, first connection fittings 15 are inserted into the second connection fittings 33 of joining pearl 7 from opposite directions and rotated, the first and second connection fittings are engaged, with the connections hidden inside joining pearl 7.

As FIGS. 12 and 13 show, pearl shortener 9, which functions as a pendant, is comprised of an ornamental piece 45 formed on base 43 and a grip 47 on the opposing surface. Grip 47 is comprised of semisplitting pieces 49 and 51 whose shapes each resemble the numeral "3." Semi-splitting pieces 49 and 51 are pivotally connected at one end by a hinge 53. Located on the opposite side of hinge 53 are an engaging ring 55 attached to piece 49 together with engagement pin 57 attached to piece 51. Ring 55 pivots from the open position shown in dashed line at 55' to its closed position shown in solid line where it engages pin 57.

When the pearl shortener 9 is opened two rows of either choker 3 or princess 5 are placed side-by-side into the C-shaped seats on one of the semi-splitting pieces. The other semi-splitting piece is then closed and ring 55 is pivoted closed to engage pin 57. Two rows of pearls can thereby be gripped and bundled in the gaps between semi-splitting pieces 49 and 51. It is, of course, possible to grip only one row of pearls.

By connecting end pearls 1A and 1B of the string of FIG. 1 with joining pearl 7, the necklace can be used as a choker. By alternatively connecting the end pearls 1 of the string of FIG. 2 with joining pearl 7, the necklace can be used as a princess. And by connecting choker 3 and princess 5 with two joining pearls 7, the resulting necklace can be used as an opera.

In each mode the connection is hidden inside joining pearl 7. Because choker 3, princess 5 and joining pearl 7 are assembled from the same type of pearls, the joining pearl 7 cannot be easily distinguished from the pearls of the choker and princess, thus retaining the aesthetic quality of the necklace. Even when an opera necklace is formed, the joining pearl 7 cannot be easily distinguished from the pearls of the choker and princess, so that the aesthetic quality is maintained.

Also, because string 13 which joins pearls 1 is passed through penetration hole 28 at the tip of first connection fitting 15 and looped back, the tip of the first connection fitting 15 remains spherical. This makes it easier for the first and second fittings to slide when in contact. In addition the tip of the first connection fitting is less likely to wear, and mechanical strength is maintained. On the other hand, for example, if the guide grooves 25 were formed to start from base 19, pass through the tip and run to the other side in the shape of the letter "U" and string 13 is strung along the tip of base 19, the second connection fitting 33 would be more likely to contact guide groove 25 at the tip and thereby increase wear and reduce mechanical strength.

Figure 14:
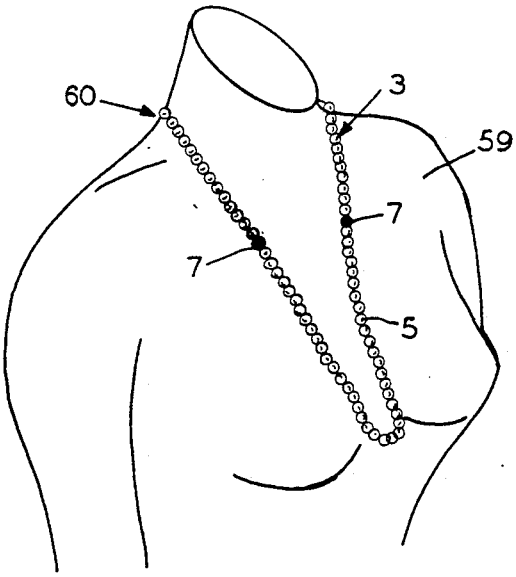
FIG. 14 is a perspective view illustrating one embodiment of the invention in use.

One specific combination of the invention is shown in FIG. 14 which provides and opera 60 worn around the neck of a person 59. The opera is formed by joining choker 3 and princess 5 using two joining pearls 7.

Figure 15:
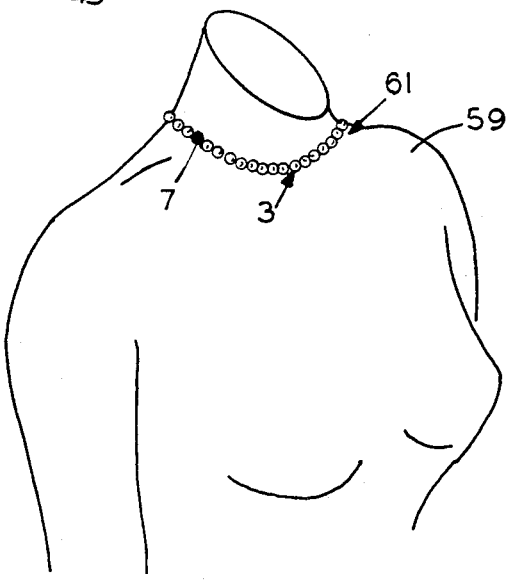
FIG. 15 is a perspective view illustrating another embodiment of the invention in use.

FIG. 15 shows another combination providing a choker 61. The choker is formed by connecting the end pearls of the choker 3 of FIG. 1 with one joining pearl 7. The choker can be worn closely around the neck.

Figure 16:
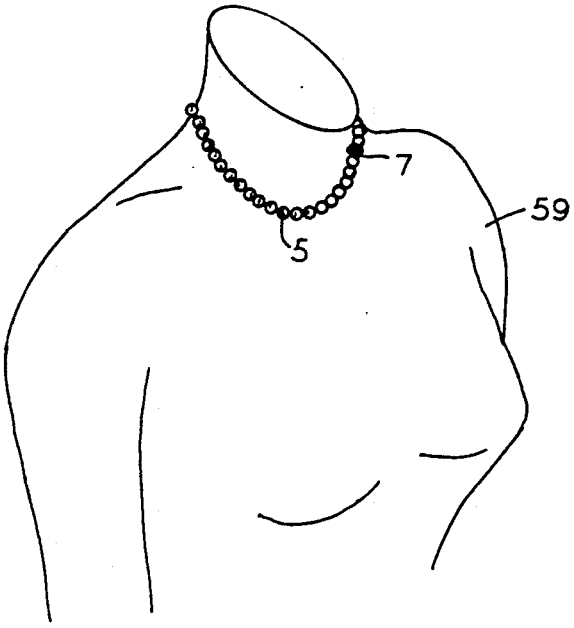
FIG. 16 is a perspective view illustrating another embodiment of the invention in use.
Figure 17:
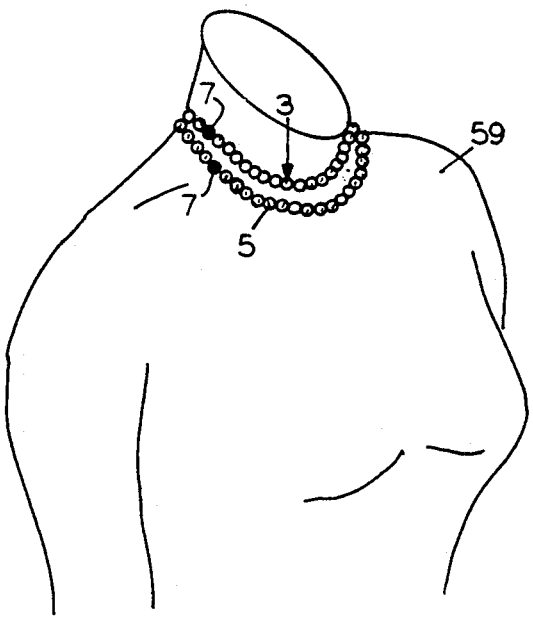
FIG. 17 is a perspective view illustrating another embodiment of the invention in use.

In the combination of FIG. 16 the end pearls of the princess 5 of FIG. 2 are connected with one joining pearl 7. The princess can then be worn loosely around the neck. FIG. 17 shows both the choker of FIG. 15 and the princess of FIG. 16 connected by two joining pieces 7 and a pearl shortener 9 for wearing around the neck.

Figure 18:
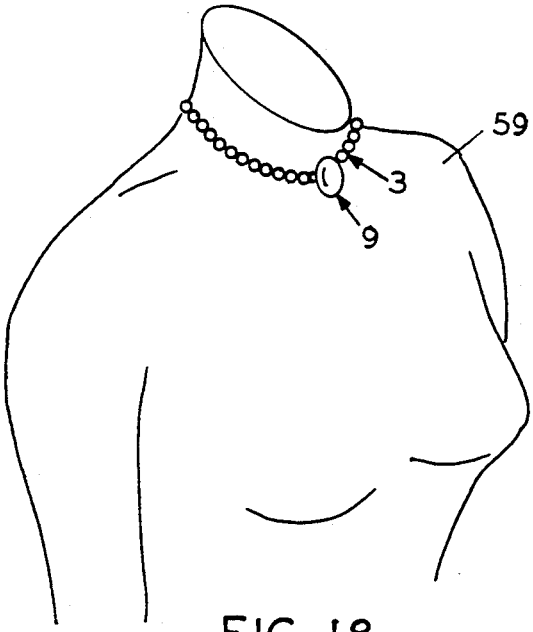
FIG. 18 is a perspective view illustrating another embodiment of the invention in use.

The present device allows a still greater number of necklaces to be configured by using pearl shortener 9 in conjunction with choker 3, princess 5 and joining pearl 7. By gripping choker 3 with pearl shortener 9 as shown in FIG. 18, a "choker with a pendant" is created. A princess 5 could be assembled in a similar manner.

Figure 19:
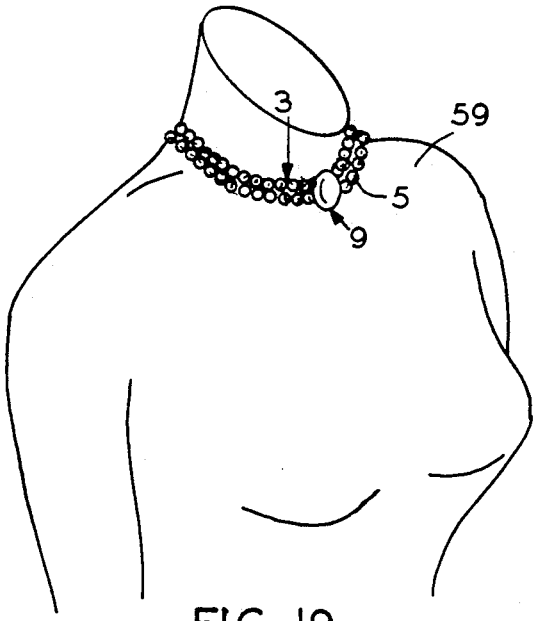
FIG. 19 is a perspective view illustrating another embodiment of the invention in use.
Figure 20:
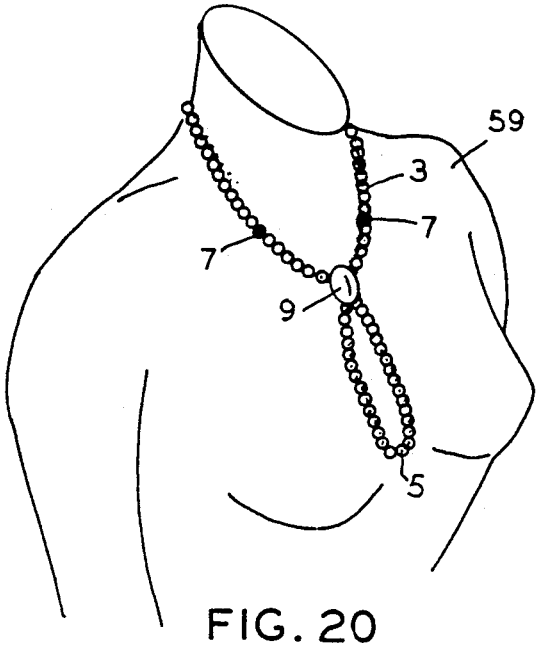
FIG. 20 is a perspective view illustrating another embodiment of the invention in use.

FIG. 19 shows an example in which choker 3 and princess 5, worn around the neck, are gripped with pearl shortener 9. FIG. 20 shows an opera gripped with pearl shortener 9 above the chest to produce an "opera with a pendant."

Figure 21:
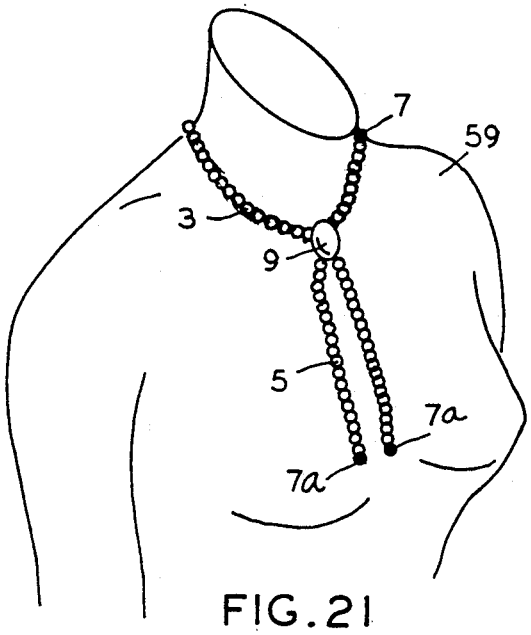
FIG. 21 is a perspective view illustrating another embodiment of the invention in use.
Figure 22:
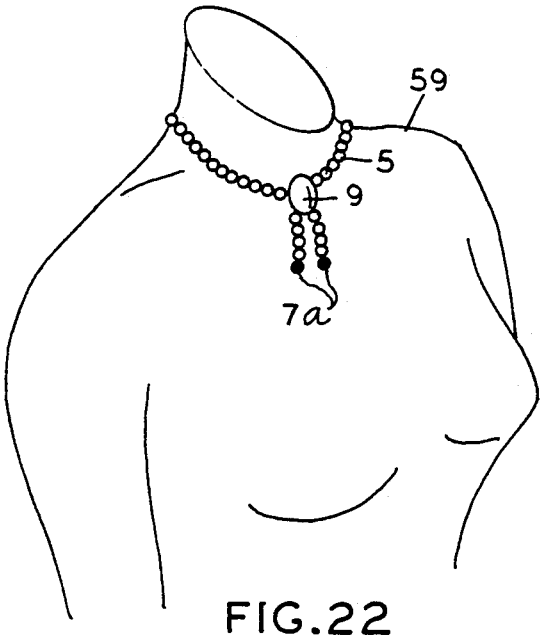
FIG. 22 is a perspective view illustrating another embodiment of the invention in use.
Figure 23:
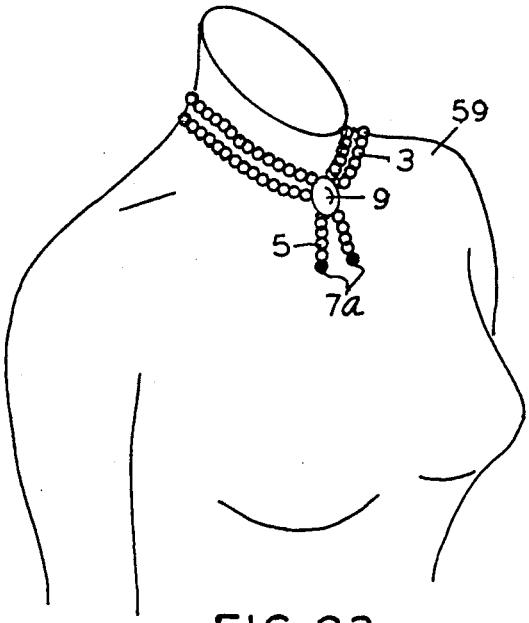
FIG. 23 is a perspective view illustrating another embodiment of the invention in use.

FIG. 21 shows the end pearls of choker 3 and princess 5 connected with joining pearl 7. Two joining pearls **7*a* are attached to each of the free ends of choker 3 and princess 5. The necklace is worn around the neck with the ends hanging down across the chest and with pearl shortener 9 gripping the two strands to produce a "pearl necktie" configuration. FIG. 22 shows joining pearls 7*a* attached to the free ends of princess 5 with a pearl shortener gripping the two strands. FIG. 23 shows a configuration that combines the styles of FIGS. 15 and 23**.

The joining pearl **7*a* may be a joining pearl where first connection fitting 15 is inserted from opposing directions such as joining pearl 7 shown in FIG. 7. The joining pearl may also be an end pearl such as that shown in FIG. 9 where first connection fitting 15** is inserted into one end and whose other end is closed by a suitable filler material, not shown. The filler material may be stamped with a mark or other symbol indicating quality.

In the foregoing embodiment, pearls were described as the "precious stones." It is understood that the invention can be implemented with other precious and semi-precious stones, such as onyx, turquoise, agate and quartz.

The foregoing embodiments have described the use of a choker and princess of standard lengths. However, it is understood that the invention may be implemented with chokers and princesses of varying lengths, as desired. Moreover, the first and second connection fittings may be of any desired shape as long as the connection fittings engage and disengage in the manner described.

Among the advantages realized from the invention are that by assembling different combinations of necklaces with either one or two joining stones, various types of necklaces can be configured that fit the time, place and ambience as well as the dress with which they are used. Another advantage is that the first and second connection fittings when inserted into the joining stones are hidden so that the aesthetic quality of the necklace is maintained. For example, if the first necklace is a choker and the second necklace is a princess, it is possible to assemble a choker, princess or opera or different variations of each. The necklaces can be worn in approximately four types of configurations, thus allowing varying styles from a limited number of pieces. If a gripping piece is used, a necklace incorporating an ornament such as a pendant can be assembled, thereby providing a total of approximately ten different styles.

If the lengths of the first and the second necklaces are different, necklaces of different configurations can be created. Still another advantage is that if the first and second necklaces and joining precious stones are comprised of stones of approximately the same diameter, then the first and second connection fittings are inconspicuous.

What is claimed is:

1. A combination necklace comprising a first necklace formed of a plurality of first stones, means for joining the first stones together into a first string of stones, a pair of first connection fittings, said first connection fittings being joined to a respective first stone at each end of the first string, each of said first connection fittings comprising a first end stone which includes an outwardly projecting mating part, a second necklace formed of a plurality of second stones of a type similar to the first stones, means for joining the second stones together into a second string of stones, and a pair of second connection fittings, said second connection fittings being joined to a respective second stone at each end of the second string, each of said second connection fittings comprising a second end stone which includes an outwardly projecting mating part, and at least one joining stone of a type similar to the first stones, said first and second stones and first and second end stones and said joining stone having substantially the same predetermined size and shape, said joining stone including means for removably engaging said connection fittings to join ends of either of the first and second strings together, said last-mentioned means includes a bore formed through the joining stone with the bore having first and second openings on opposite sides of the joining stone, said bore being sized sufficient to slidably receive said mating parts of the first and second connection fittings through respective first and second openings, said joining stone including an engagement protrusion concealed within the bore for releasably holding the mating parts of the first and second connection fittings to the joining stone.

2. A combination necklace as in claim 1 including a gripping piece, said gripping piece having means to bundle and grip a selected portion of the first necklace with another portion of the first necklace or with a selected portion of the second necklace.

3. A combination necklace as in claim 2 in which the first and second necklaces are of disparate lengths.

4. A combination necklace as in claim 1 in which the first and second necklaces are of disparate lengths.

5. A combination necklace as in claim 4 in which the diameters of the stones of the first and second necklaces and of the joining stone are approximately equal.

* * * * *